US008059987B2

(12) United States Patent
Ushiyama

(10) Patent No.: US 8,059,987 B2
(45) Date of Patent: Nov. 15, 2011

(54) IMAGE FORMING APPARATUS AND METHOD OF ADJUSTING COVER POSITION OF IMAGE FORMING APPARATUS

(75) Inventor: Yousuke Ushiyama, Mishima (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 670 days.

(21) Appl. No.: 12/207,414

(22) Filed: Sep. 9, 2008

(65) Prior Publication Data

US 2009/0074457 A1 Mar. 19, 2009

Related U.S. Application Data

(60) Provisional application No. 60/971,229, filed on Sep. 10, 2007.

(51) Int. Cl.
*G03G 15/00* (2006.01)

(52) U.S. Cl. ..... 399/110

(58) Field of Classification Search ..... 399/110, 399/107, 124–126; 16/50
See application file for complete search history.

(56) References Cited

U.S. PATENT DOCUMENTS

| | | | | |
|---|---|---|---|---|
| 6,446,305 | B1 * | 9/2002 | Kneeland | 16/82 |
| 2002/0031369 | A1 * | 3/2002 | Tokutake et al. | 399/110 |
| 2002/0041775 | A1 * | 4/2002 | Ishii | 399/124 |
| 2003/0118367 | A1 * | 6/2003 | Omata et al. | 399/110 |
| 2007/0025764 | A1 | 2/2007 | Maeda | |
| 2007/0059033 | A1 * | 3/2007 | Kitozaki | 399/110 |

FOREIGN PATENT DOCUMENTS

| | | |
|---|---|---|
| JP | 2005-4069 | 1/2005 |

* cited by examiner

*Primary Examiner* — David Gray
*Assistant Examiner* — Rodney Bonnette
(74) *Attorney, Agent, or Firm* — Patterson & Sheridan, LLP

(57) ABSTRACT

An image forming apparatus includes an outer case which includes a first opening portion and a second opening portion provided just below the first opening portion, a withdrawable part which is received in the inside of the first opening portion so as to be withdrawn from the first opening portion in a horizontal direction, a cover which closes the second opening portion, a rotary shaft supports the cover so as to be rotatable from a first position where the cover closes the outer case to a second position where the cover opens the outer case, and a position adjusting mechanism which moves up the cover so as to be close to the withdrawable part at the first position and moves down the cover so as to be away from the withdrawable part at the second position.

14 Claims, 7 Drawing Sheets

IMAGE FORMING APPARATUS AND METHOD OF ADJUSTING COVER POSITION OF IMAGE FORMING APPARATUS

CROSS-REFERENCE TO RELATED APPLICATIONS

This application claims the benefit of U.S. Provisional Application No. 60/971,229, filed Sep. 10, 2007.

TECHNICAL FIELD

The present invention relates to an image forming apparatus having an openable cover.

BACKGROUND

JP-A-2005-004069 discloses an image forming apparatus for preventing interference between an outer cover and an inner unit. The image forming apparatus includes an apparatus body having an opening portion, an inner unit received in the inside of the opening portion of the apparatus body, an outer cover rotatable between a position for closing the opening portion and a position for opening the opening portion, and a contact body provided in the inner surface of the outer cover and coming into contact with the side surface of the inner unit. The inner unit is withdrawable in a horizontal direction.

In the image forming apparatus, the contact body comes into contact with the side surface of the inner unit before a position where the outer cover interferes with the inner unit. Accordingly, the interference between the outer cover and the inner unit is prevented, thereby preventing the breakage of the inner unit and the outer cover caused by the interference.

Incidentally, in many cases, the same cover as the outer cover is provided just below the withdrawable part (inner unit) in order to solve a paper jam. Additionally, the withdrawable part tends to be bent downward due to the own weight while being withdrawn in a horizontal direction. For this reason, when the cover just below the withdrawable part is opened in this state, the withdrawable part interferes with the cover, thereby causing the breakage therebetween. Meanwhile, when a clearance is formed therebetween in order to prevent the interference between the withdrawable part and the cover therebelow, a gap is formed between the withdrawable part and the cover, thereby spoiling an exterior appearance of the image forming apparatus.

SUMMARY

An object of the invention is to provide an image forming apparatus capable of preventing the interference between the withdrawable part and the cover therebelow while ensuring the exterior appearance.

In order to achieve the above-described object, according to an aspect of the invention, there is provided an image forming apparatus including: an outer case which includes a first opening portion and a second opening portion provided just below the first opening portion; a withdrawable part which is received in the inside of the first opening portion so as to be withdrawn from the first opening portion in a horizontal direction; a cover which closes the second opening portion; a rotary shaft which extends along an edge of the second opening portion in a vertical direction and supports the cover so as to be rotatable from a first position where the cover closes the outer case to a second position where the cover opens the outer case; and a position adjusting mechanism which moves up the cover so as to be close to the withdrawable part at the first position and moves down the cover so as to be away from the withdrawable part at the second position.

In order to achieve the above-described object, according to another aspect of the invention, there is provided an image forming apparatus including: an outer unit which includes a first opening portion and a second opening portion provided just below the first opening portion; a withdrawable unit which is received in the inside of the first opening portion so as to be withdrawn from the first opening portion in a horizontal direction; a cover unit which closes the second opening portion; a support unit which extends along an edge of the second opening portion in a vertical direction and supports the cover unit so as to be rotatable from a first position where the cover unit closes the outer unit to a second position where the cover unit opens the outer unit; and a position adjusting unit which moves up the cover unit so as to be close to the withdrawable unit at the first position and moves down the cover unit so as to be away from the withdrawable unit at the second position.

According to the invention, it is possible to obtain the image forming apparatus capable of preventing the interference between the withdrawable part and the cover therebelow while ensuring the exterior appearance.

Objects and advantages of the invention will become apparent from the description which follows, or may be learned by practice of the invention.

DESCRIPTION OF THE DRAWINGS

The accompanying drawings illustrate embodiments of the invention, and together with the general description given above and the detailed description given below, serve to explain the principles of the invention.

DETAILED DESCRIPTION

Hereinafter, exemplary embodiments of the invention will be described in detail with reference to the accompanying drawings.

Figure 1:
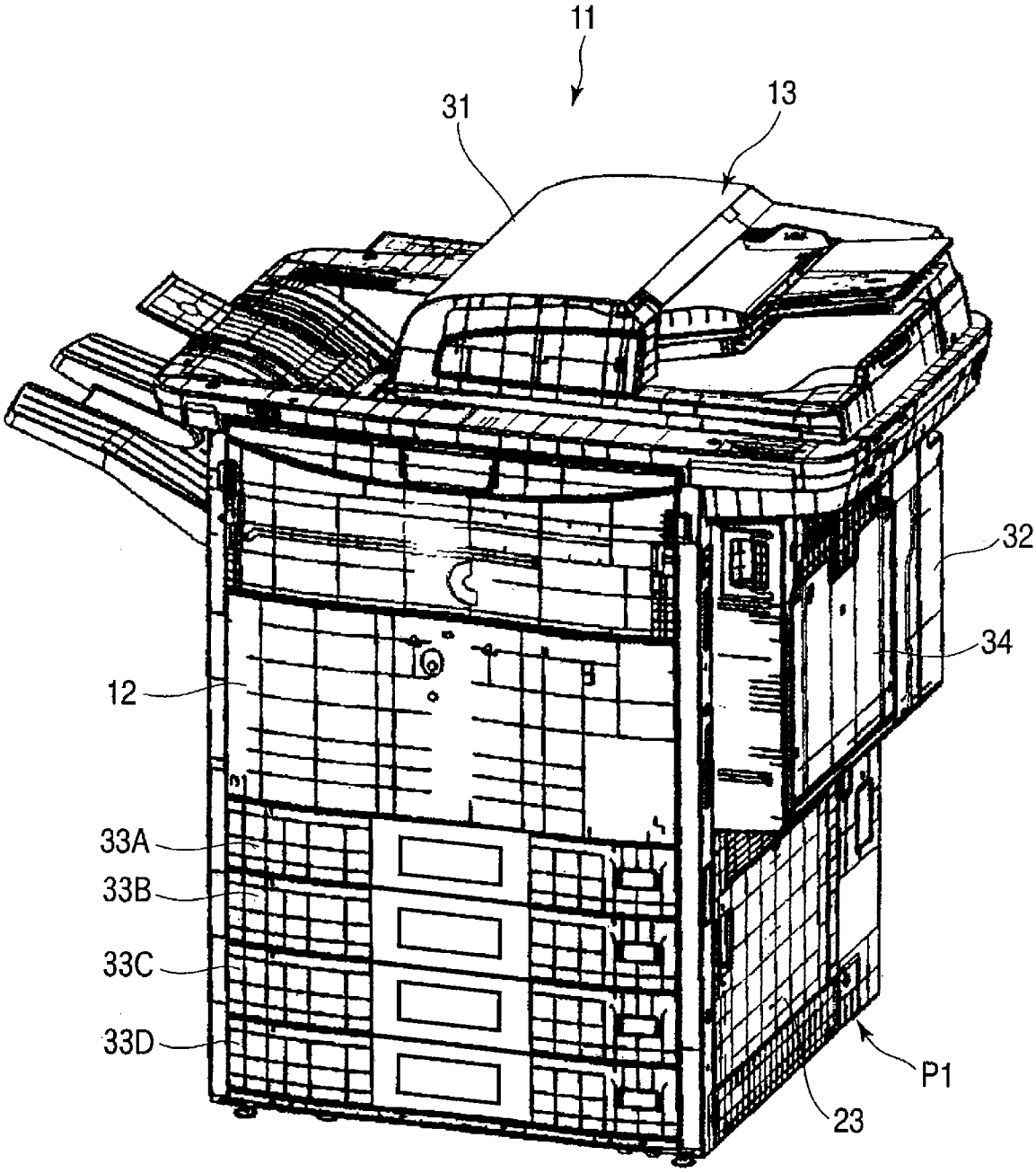
FIG. 1 is a perspective view showing an image forming apparatus according to an embodiment.

FIG. 1 shows a digital copy machine 11. The digital copy machine 11 is an example of the image forming apparatus according to the invention.

The digital copy machine 11 includes an outer case 12 corresponding to an outer cover of the apparatus, and the upper surface of the outer case 12 is provided with a document placement table configured as a transparent glass plate. An openable automatic document feeder 13 (hereinafter, simply referred to as an ADF 13) is provided on the document placement table. The ADF 13 is configured to automatically send the document to a predetermined position on the document placement table.

For example, after a document is set on a paper feeding tray of the ADF 13, the stapling selection, the stapling method, the number of papers to be copied, and the paper size are set. Upon pushing a copy start switch, each sheet of the document set on the paper feeding tray is automatically fed to a document reading position of the document placement table, and is automatically discharged at an appropriate timing after reading the document.

The digital copy machine 11 includes a first opening portion 21 which is provided in the upper half portion of the apparatus; a second opening portion 22 which is provided just below the first opening portion 21 and is provided in the lower half portion of the apparatus; a cover 23 which is configured to close the second opening portion 22; a rotary shaft 24 which supports the cover 23 so as to be rotatable from a first position P1 where the cover 23 closes the outer case 12 to a second position P2 where the cover 23 opens the outer case 12; and a position adjusting mechanism 25 which adjusts the mounting height of the cover 23 upon rotating the cover 23.

The digital copy machine 11 further includes a scanner part 31, a printer part 32, cassettes 33A, 33B, 33C, and 33D for a copy paper (hereinafter, simply referred to as a paper P) which are provided in the inside of the outer case 12. The printer part 32 is received in the inside of the first opening portion 21. The printer part 32 includes an exclusive-use cover 34 which covers the first opening portion 21. The printer part 32 is mounted to the digital copy machine 11 so as to be withdrawn from the first opening portion 21 via a rail 35 in a horizontal direction or to be returned to the first opening portion 21 via the rail 35. The printer part 32 corresponds to a withdrawable part according to the invention.

The printer part 32 drives a laser device on the basis of image information read by the scanner part 31, and forms an electrostatic latent image based on the image information on a peripheral surface of a photoconductive drum. Then, the printer part 32 develops the image by supplying a toner to the electrostatic latent image of the photoconductive drum using a developing device and transfers the toner image to the paper P using a transfer charger. At this time, any one of the cassettes 33A, 33B, 33C, and 33D feeds the paper P.

Additionally, the printer part 32 supplies the paper P having the toner image transferred thereto to a fixing device, and fixes the toner image onto the paper P in terms of heating and melting.

The cover 23 is formed into a square shape. The cover 23 is capable of rotating about the rotary shaft 24 described below from the first position P1 where the cover 23 closes the outer case 12 to the second position P2 where the cover 23 opens the outer case 12. The cover 23 includes a first clasp 36 into which a first portion 41 of the rotary shaft 24 is inserted and a second clasp 37 into which a second portion 42 of the rotary shaft 24 is inserted.

The rotary shaft 24 extends along the edge of the second opening portion 22 in a vertical direction. The rotary shaft 24 includes the first portion 41 which is provided on the upper side of the second opening portion 22 and the second portion 42 which is provided on the lower side of the second opening portion 22. The first portion 41 and the second portion 42 are formed of metal material. The first portion 41 and the second portion 42 are screw-fixed to the outer case 12.

Figure 4:
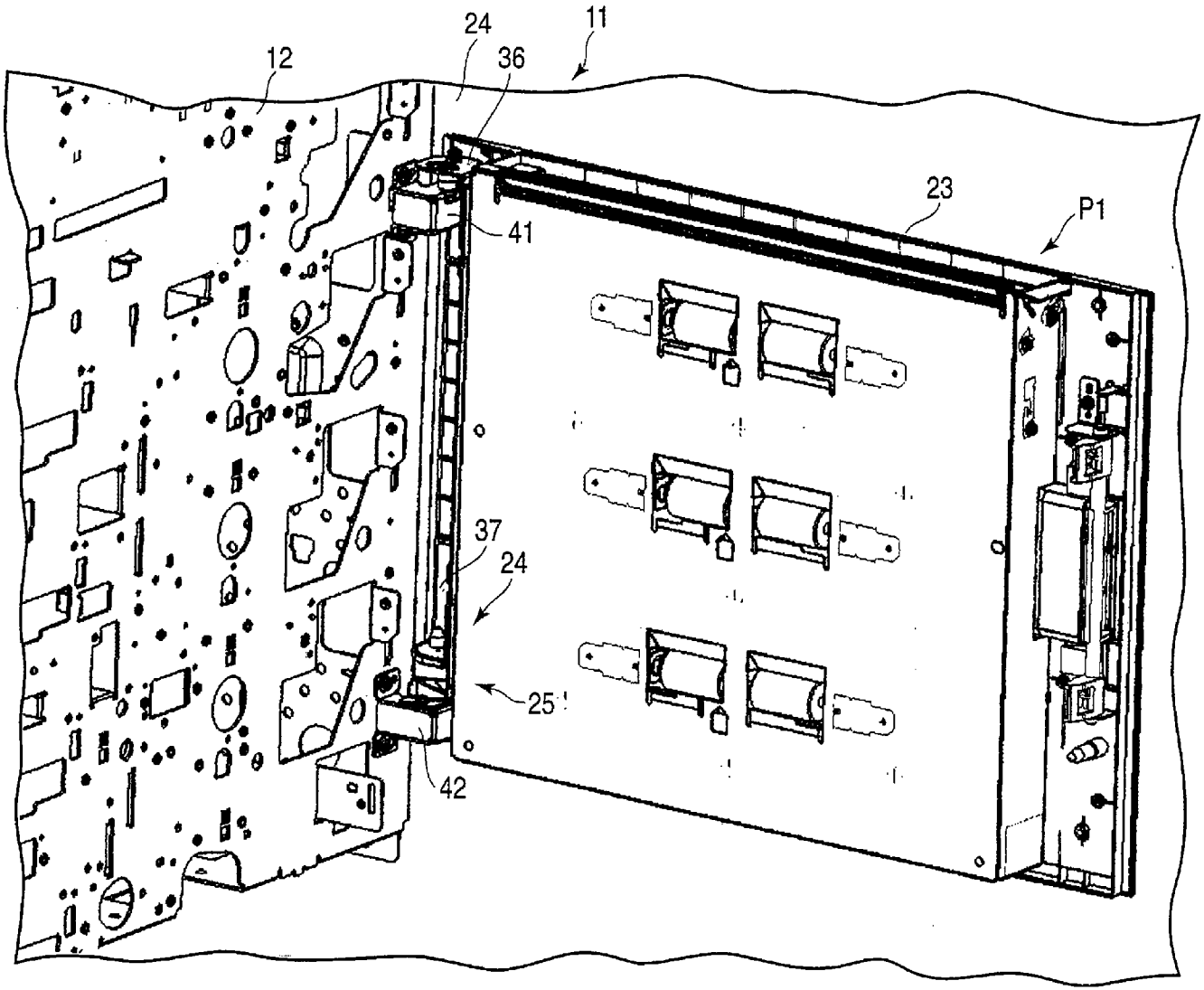
FIG. 4 is a perspective view showing a cover and a rotary shaft of the image forming apparatus shown in FIG. 1 when viewed from the inside.
Figure 5:
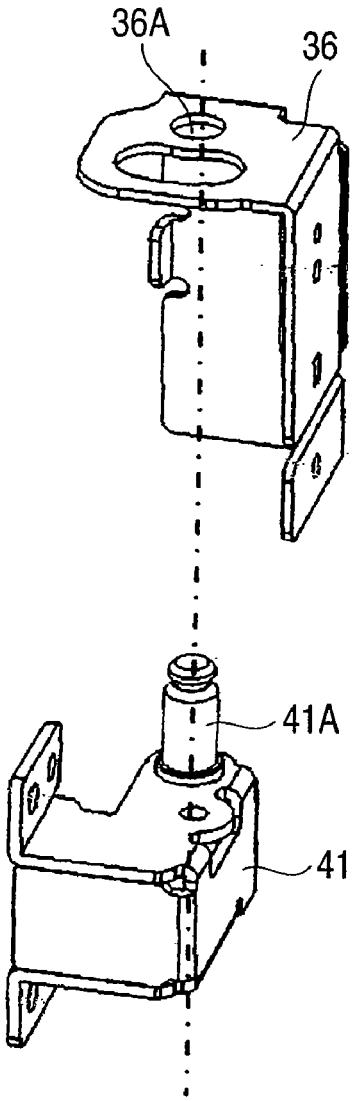
FIG. 5 is an exploded perspective view showing a structure in the periphery of a first portion of the rotary shaft shown in FIG. 4.

As shown in FIGS. 4 and 5, the first portion 41 is fixed to the outer case 12. A first rotary shaft body 41A of the first portion 41 passes through the inside of a first through-hole 36A of the first clasp 36.

Figure 6:
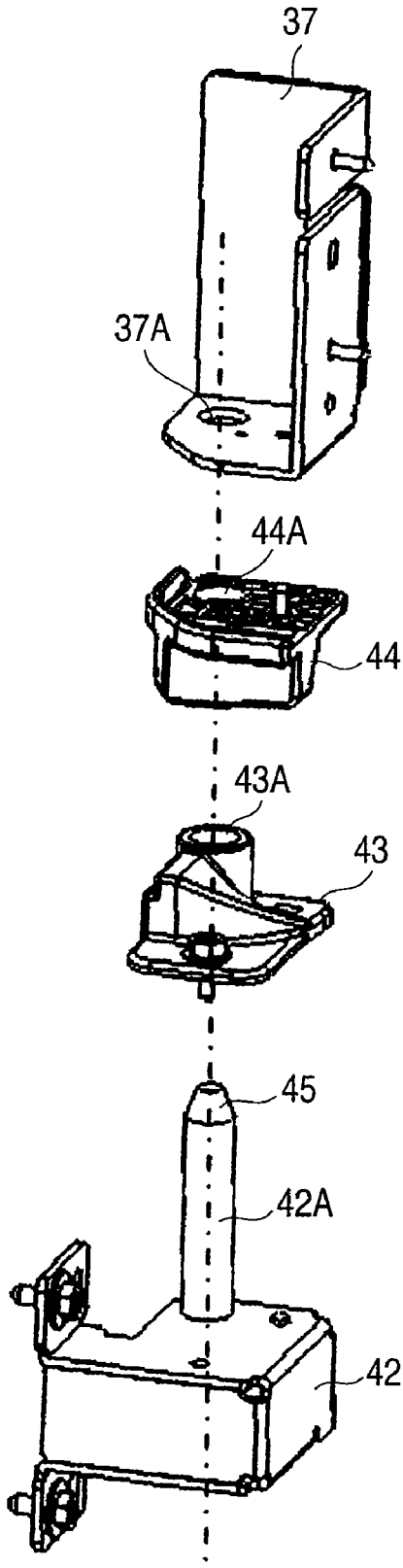
FIG. 6 is an exploded perspective view showing a structure in the periphery of a position adjusting mechanism and a second portion of the rotary shaft shown in FIG. 4.
Figure 7:
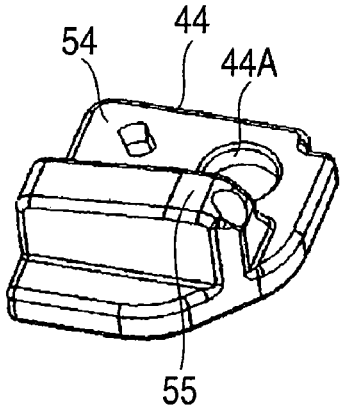
FIG. 7 is a perspective view showing a slide member of the position adjusting mechanism shown in FIG. 6 when viewed from the downside.
Figure 8:
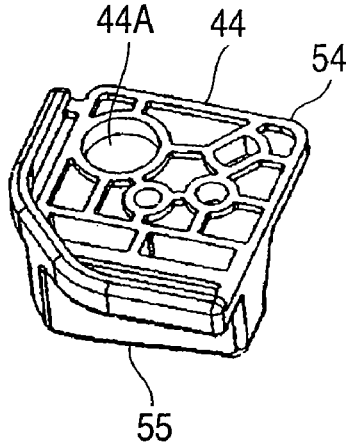
FIG. 8 is a perspective view showing the slide member of the position adjusting mechanism shown in FIG. 6 when viewed from the upside.
Figure 9:
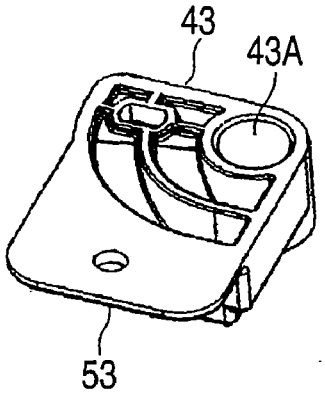
FIG. 9 is a perspective view showing a slope member of the position adjusting mechanism shown in FIG. 6 when viewed from the downside.
Figure 10:
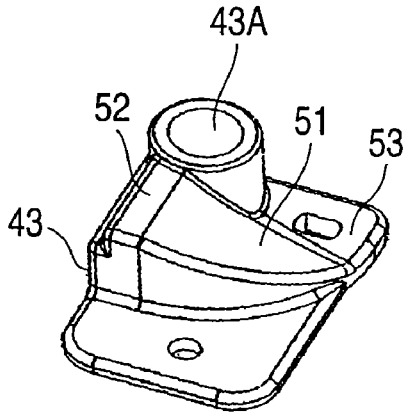
FIG. 10 is a perspective view showing the slope member of the position adjusting mechanism shown in FIG. 6 when viewed from the upside.

As shown in FIGS. 4 and 6, the second portion 42 is fixed to the outer case 12. A second rotary shaft body 42A of the second portion 42 passes through a second through-hole 37A of the second clasp 37, a third through-hole 43A of a slope member 43 of the position adjusting mechanism 25, and a fourth through-hole 44A of a slide member 44 of the position adjusting mechanism 25. The second rotary shaft body 42A includes a taper portion 45 which becomes thinner toward the front end portion. The cover 23 is inserted into the first portion 41 and the second portion 42 of the rotary shaft 24 from the upside so as to be rotatably fixed to the outer case 12.

The position adjusting mechanism 25 is capable of moving up the cover 23 so as to be located at a position close to the printer part 32 at the first position P1 and moving down the cover 23 so as to be located at a position away from the printer part 32 at the second position P2. As shown in FIG. 4, the position adjusting mechanism 25 is provided in the vicinity of the second portion 42 of the rotary shaft 24. The position adjusting mechanism 25 includes the slope member 43 which is fixed to the outer case 12 via the second portion 42 of the rotary shaft 24 and the slide member 44 which is fixed to the cover 23 via the second clasp 37. The slope member 43 is screw-fixed to the second portion 42. Additionally, the slide member 44 is screw-fixed to the second clasp 37.

The slope member 43 is integrally formed of synthetic resin. The slope member 43 includes a slope surface 51 which is obliquely inclined with respect to a horizontal plane, a first flat surface 52 which is provided in one end portion, that is, the upper end portion of the slope surface 51, and a second flat surface 53 which is provided in the other end portion, that is, the lower end portion of the slope surface 51. The first flat surface 52 and the second flat surface 53 are formed in horizontal.

The slide member 44 is integrally formed of synthetic resin. The slide member 44 includes a base portion 54 and a slide surface 55 which protrudes upward from the base portion 54 and corresponds to a contact portion coming into contact with the slope member 43. The slide member 44 is capable of sliding on the slope surface 51 of the slope member 43 via the slide surface 55. Additionally, the arrangement of the slope member 43 and the slide member 44 is not limited to the above-described embodiment. On the contrary to this embodiment, even when the slope member 43 is fixed to the cover 23 and the slide member 44 is fixed to the outer case 12, it is possible to decrease the mounting height of the cover 23 upon opening the cover 23.

Next, an operation in which the cover 23 moves from the first position P1 to the second position P2 will be described with reference to FIGS. 4, 11, and 12.

Figure 2:
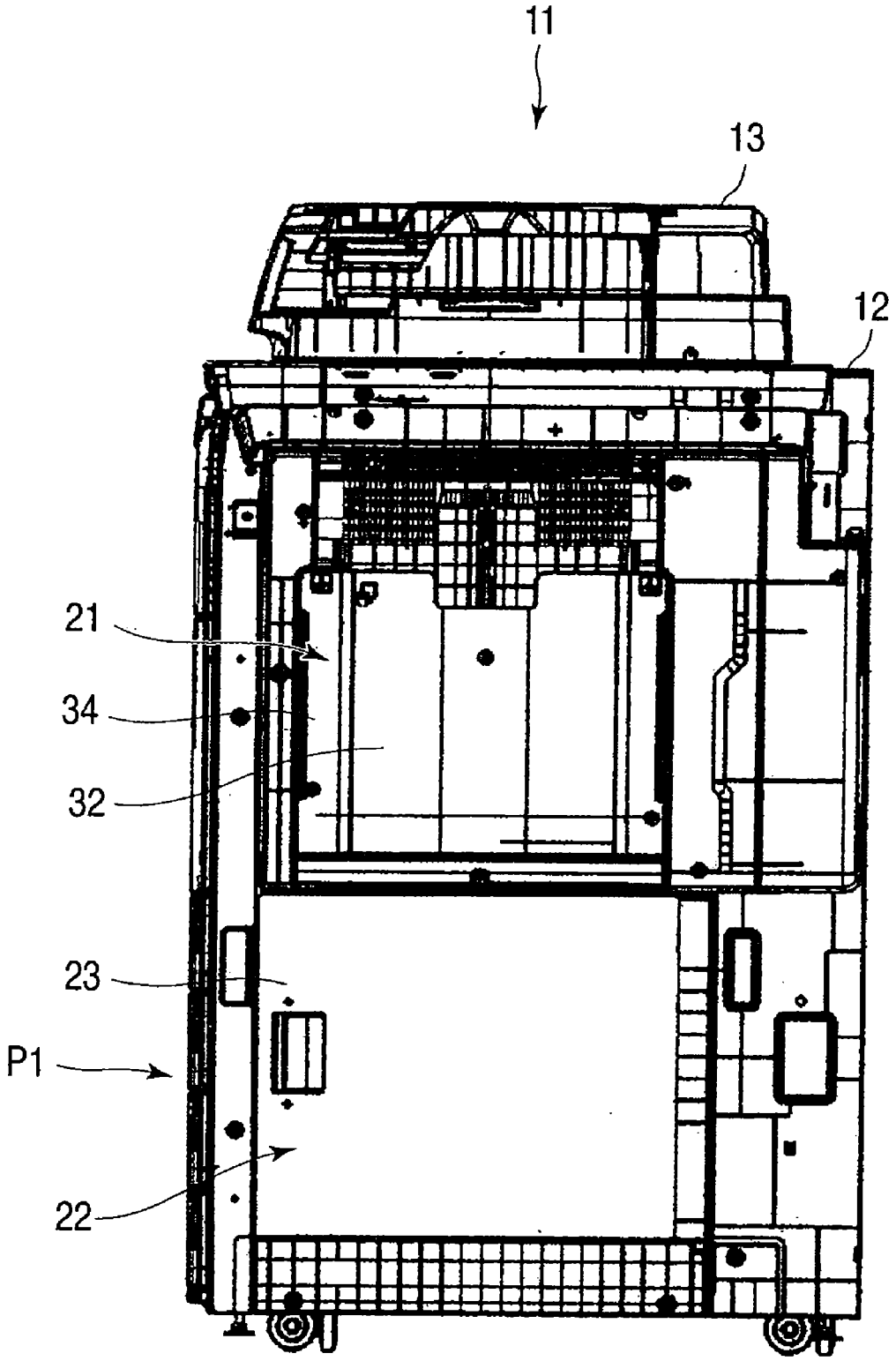
FIG. 2 is a side view showing the image forming apparatus shown in FIG. 1 when viewed in a transverse direction.
Figure 11:
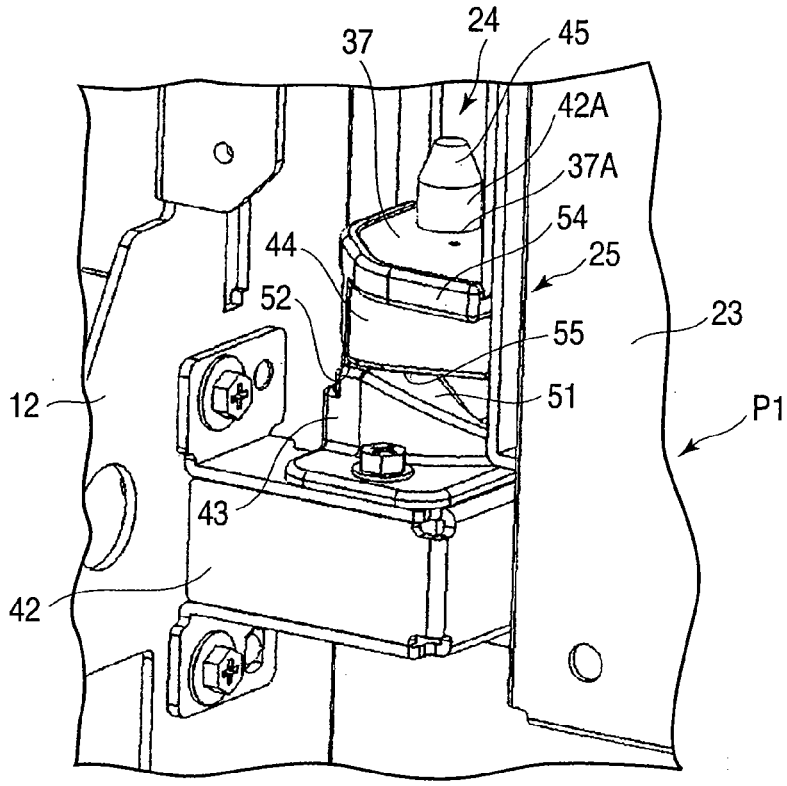
FIG. 11 is an enlarged perspective view showing the position adjusting mechanism and the second portion of the rotary shaft shown in FIG. 4.

In FIGS. 4 and 11, the cover 23 is located at the first position P1 where the cover 23 closes the outer case 12. In this state, the slide surface 55 of the slide member 44 comes into contact with the first flat surface 52 of the slope member 43. Additionally, as shown in FIG. 2, the upper surface of the cover 23 closely contact to the lower end portion of the printer part 32 as the withdrawable part. The first flat surface 52 is capable of holding the slide member 44 in a stop state when the cover 23 is located at the first position P1. Accordingly, it is possible to prevent the cover 23 from being opened of itself at an undesirable timing.

Figure 3:
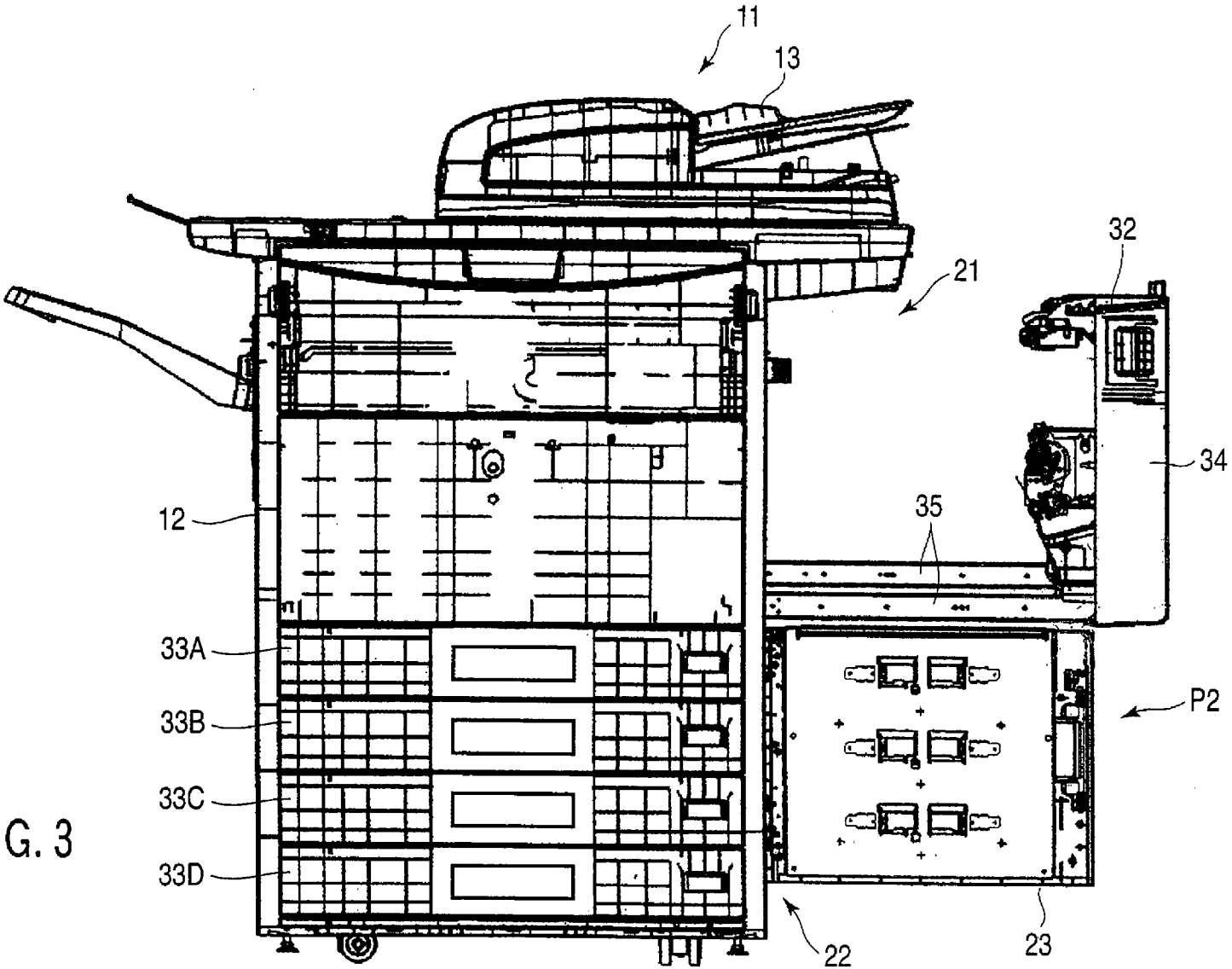
FIG. 3 is a front view showing the image forming apparatus shown in FIG. 1 when viewed from the front side.
Figure 12:
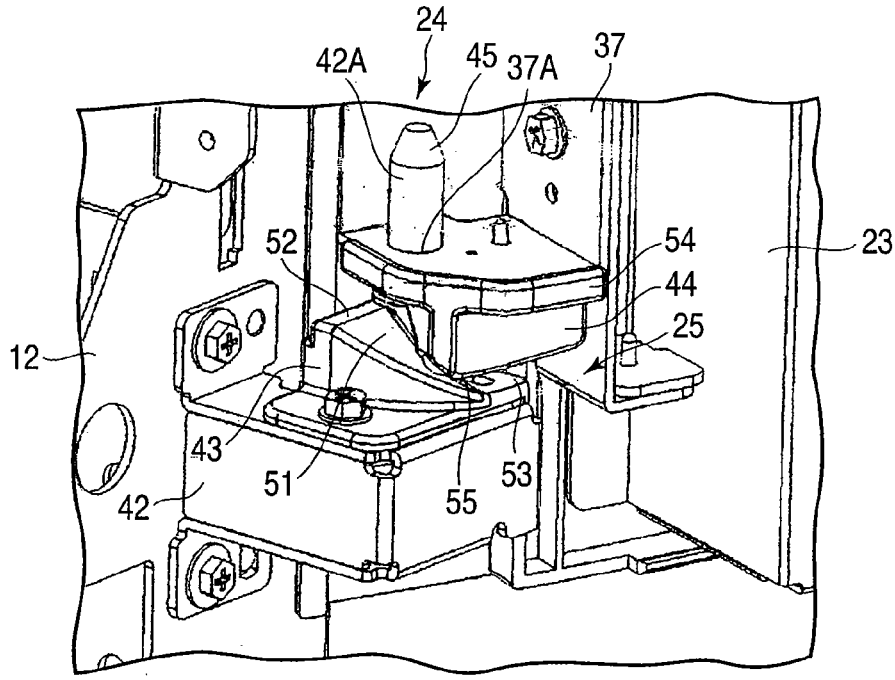
FIG. 12 is a perspective view showing a state where the slide member of the position adjusting mechanism shown in FIG. 11 comes into contact with a slope surface of the slope member.

When the cover 23 moves from the first position P1 to the second position P2, as shown in FIG. 12, the slide surface 55 of the slide member 44 slides on the slope surface 51 of the slope member 43 in a descending direction. Accordingly, the mounting height of the cover 23 gradually decreases. Then, as shown in FIG. 3, when the cover 23 is located at the second position P2 where the cover 23 completely opens the outer case 12, the mounting height of the cover 23 more decreases than that at the first position P1 by several millimeters to several tens of millimeters. Accordingly, as shown in FIG. 3, even when the printer part 32 is bent downward due to the own weight upon withdrawing the printer part 32, it is possible to prevent the cover 23 from coming into contact with the printer part 32.

At this time, the slide surface 55 of the slide member 44 comes into contact with the second flat surface 53 of the slope member 43. The second flat surface 53 is capable of holding the slide member 44 in a stop state when the cover 23 is located at the second position P2.

Meanwhile, when the cover 23 moves from the second position P2 to the first position P1, the slide member 44 slides on the slope member 43 in an opposite sequence to the above-described sequence. That is, the slide member 44 held on the second flat surface 53 slides on the slope surface 51 in an ascending direction to be thereby held on the first flat surface 52. Accordingly, it is possible to again maintain the upper surface of the cover 23 to closely contact to the lower end portion of the printer part 32.

According to this embodiment, the image forming apparatus 11 includes the outer case 12 having the first opening portion 21 and the second opening portion 22 provided just below the first opening portion 21; the withdrawable part which is received in the inside of the first opening portion 21 so as to be withdrawn from the first opening portion 21 in a horizontal direction; the cover 23 which closes the second opening portion 22; the rotary shaft 24 which extends along the edge of the second opening portion 22 in a vertical direction and supports the cover 23 so as to be rotatable from the first position P1 where the cover 23 closes the outer case 12 to the second position P2 where the cover 23 opens the outer case 12; and the position adjusting mechanism 25 which moves up the cover 23 so as to be located at a position close to the withdrawable part at the first position P1 and moves down the cover 23 so as to be located at a position away from the withdrawable part at the second position P2.

With such a configuration, since the mounting height of the cover 23 decreases upon opening the cover 23 by using the position adjusting mechanism 25, even when the cover 23 is opened upon withdrawing the upper withdrawable part, the cover 23 cannot collide with the withdrawable part. For this reason, it is possible to prevent the cover 23 and the withdrawable part from being broken.

In this case, the position adjusting mechanism 25 includes the slope member 43 which is fixed to one of the outer case 12 and the cover 23 and has the slope surface 51, and the slide member 44 which is fixed to the other of the outer case 12 and the cover 23 and slides on the slope surface 51. The slide member 44 slides on the slope surface 51 in a descending direction when the cover 23 moves from the first position P1 to the second position P2. The slide member 44 slides on the slope surface 51 in an ascending direction when the cover 23 moves from the second position P2 to the first position P1.

With such a configuration, it is possible to realize the position adjusting mechanism 25 with a simple configuration having the slope member 43 and the slide member 44. Additionally, since the slope member 43 is provided, it is possible to gradually decrease the mounting height of the cover 23 upon moving the cover 23 from the first position P1 to the second position P2. Accordingly, it is possible to decrease the mounting height of the cover 23 without interrupting the opening operation of the cover 23. Additionally, since the slide member 44 slides on the slope surface 51 of the slope member 43 in an ascending direction when the cover 23 moves from the second position P2 to the first position P1, it is possible to smoothly increase the mounting height of the cover 23 without interrupting the closing operation of the cover 23.

In this case, the position adjusting mechanism 25 is disposed in the vicinity of the rotary shaft 24. With such a configuration, it is possible to realize a compact in size of the position adjusting mechanism 25 because the distance of the slope surface 51 of the slope member 43 may be configured to be short. Accordingly, it is possible to realize a compact in size of the image forming apparatus 11 as a whole by reducing a space necessary for mounting the position adjusting mechanism 25.

In this case, the slope member 43 includes the first flat surface 52 provided in one end portion of the slope surface 51, and the first flat surface 52 holds the slide member 44 in a stop state when the cover 23 is located at the first position P1. With such a configuration, it is possible to prevent the slide member 44 from sliding on the slope surface of the slope member 43 in a descending direction when the cover 23 is located at the first position P1, that is, the closed position, thereby preventing the cover 23 from being opened of itself.

In this case, the slope member 43 includes the second flat surface 53 provided in the other end portion of the slope surface 51, and the second flat surface 53 holds the slide member 44 in a stop state when the cover 23 is located at the second position P2. With such a configuration, it is possible to stably hold the cover 23 at the second position P2 when the cover 23 is located at the second position P2, that is, the opened position.

Additional advantages and modifications will readily occur to those skilled in the art. Therefore, the invention on its broader aspects is not limited to the specific details and representative embodiments shown and described herein. Accordingly, various modifications may be made without departing from the spirit or scope of the inventive as defined by the appended claims and equivalents thereof.

What is claimed is:

1. An image forming apparatus comprising:

an outer case which includes a first opening portion and a second opening portion provided just below the first opening portion;

a withdrawable part which is received in the inside of the first opening portion so as to be withdrawn from the first opening portion in a horizontal direction;

a cover which closes the second opening portion;

a rotary shaft which extends along an edge of the second opening portion in a vertical direction and supports the cover so as to be rotatable from a first position where the cover closes the outer case to a second position where the cover opens the outer case; and a position adjusting mechanism which moves up the cover so as to be close to the withdrawable part at the first position and moves down the cover so as to be away from the withdrawable part at the second position.

2. The apparatus according to claim 1, wherein the position adjusting mechanism includes a slope member which is fixed to one of the outer case and the cover and includes a slope surface and a slide member which is fixed to the other of the outer case and the cover and slides on the slope surface, and wherein the slide member slides on the slope surface in a descending direction of the slope surface when the cover moves from the first position to the second position and slides on the slope surface in an ascending direction of the slope surface when the cover moves from the second position to the first position.

3. The apparatus according to claim 2, wherein the position adjusting mechanism is disposed in the vicinity of the rotary shaft.

4. The apparatus according to claim 3, wherein the slope member includes a first flat surface provided in one end portion of the slope surface, and wherein the first flat surface holds the slide member in a stop state when the cover is located at the first position.

5. The apparatus according to claim 4, wherein the slope member includes a second flat surface provided in the other end portion of the slope surface, and wherein the second flat surface holds the slide member in a stop state when the cover is located at the second position.

6. An image forming apparatus comprising:

an outer unit which includes a first opening portion and a second opening portion provided just below the first opening portion;

a withdrawable unit which is received in the inside of the first opening portion so as to be withdrawn from the first opening portion in a horizontal direction;

a cover unit which closes the second opening portion;

a support unit which extends along an edge of the second opening portion in a vertical direction and supports the cover unit so as to be rotatable from a first position where the cover unit closes the outer unit to a second position where the cover unit opens the outer unit; and a position adjusting unit which moves up the cover unit so as to be close to the withdrawable unit at the first position and moves down the cover unit so as to be away from the withdrawable unit at the second position.

7. The apparatus according to claim 6, wherein the position adjusting unit includes a slope member which is fixed to one of the outer unit and the cover unit and includes a slope surface and a slide member which is fixed to the other of the outer unit and the cover unit and slides on the slope surface, and wherein the slide member slides on the slope surface in a descending direction of the slope surface when the cover unit moves from the first position to the second position and slides on the slope surface in an ascending direction of the slope surface when the cover unit moves from the second position to the first position.

8. The apparatus according to claim 7, wherein the position adjusting unit is disposed in the vicinity of the support unit.

9. The apparatus according to claim 8, wherein the slope member includes a first flat surface provided in one end portion of the slope surface, and wherein the first flat surface holds the slide member in a stop state when the cover unit is located at the first position.

10. The apparatus according to claim 9, wherein the slope member includes a second flat surface provided in the other end portion of the slope surface, and wherein the second flat surface holds the slide member in a stop state when the cover unit is located at the second position.

11. A method of adjusting a cover position of the image forming apparatus including an outer case which includes a first opening portion and a second opening portion provided just below the first opening portion; a withdrawable part which is received in the inside of the first opening portion so as to be withdrawn from the first opening portion in a horizontal direction; a cover which closes the second opening portion; a rotary shaft which supports the cover; and a position adjusting mechanism which adjusts the position of the cover, wherein the rotary shaft supports the cover so as to be rotatable from a first position where the cover closes the outer case to a second position where the cover opens the outer case, and wherein the position adjusting mechanism moves up the cover so as to be close to the withdrawable part at the first position and moves down the cover so as to be away from the withdrawable part at the second position.

12. The method according to claim 11, wherein the position adjusting mechanism includes a slope member which is fixed to one of the outer case and the cover and includes a slope surface and a slide member which is fixed to the other of the outer case and the cover and slides on the slope surface, and wherein the slide member slides on the slope surface in a descending direction of the slope surface when the cover moves from the first position to the second position and slides on the slope surface in an ascending direction of the slope surface when the cover moves from the second position to the first position.

13. The method according to claim 12, wherein when the cover is located at the first position, the slide member is held in a stop state by a first flat surface provided in one end portion of the slope surface.

14. The method according to claim 13, wherein when the cover is located at the second position, the slide member is held in a stop state by a second flat surface provided in the other end portion of the slope surface.

* * * * *